United States Patent [19]

Yokoyama

[11] Patent Number: 4,934,994

[45] Date of Patent: Jun. 19, 1990

[54] MANDREL INSERTION MECHANISM IN A CARTON CONTAINER-FORMING DEVICE

[75] Inventor: Yoshimitsu Yokoyama, Ishikawa, Japan

[73] Assignee: Milliken Packaging, Spartanburg, S.C.

[21] Appl. No.: 274,853

[22] Filed: Nov. 22, 1988

[51] Int. Cl.[5] ..... B31B 1/16; B31B 1/78

[52] U.S. Cl. ..... 493/309; 493/74; 493/163; 493/175; 493/250; 493/255

[58] Field of Search ..... 493/52, 125, 126, 127, 493/163, 164, 175, 176, 255, 309, 69, 70, 71, 72, 79, 80, 81, 250, 252, 255, 56, 62, 74

[56] References Cited

U.S. PATENT DOCUMENTS

| | | | |
|---|---|---|---|
| 2,581,491 | 1/1952 | Linstedt | 493/175 |
| 2,854,899 | 10/1958 | Bauder et al. | 493/252 |
| 3,418,894 | 12/1968 | Jivoin | 493/309 |
| 3,988,970 | 11/1976 | Hanson et al. | 493/252 |
| 4,530,692 | 7/1985 | Williams | 493/309 |
| 4,759,171 | 7/1988 | Bruveris et al. | 53/563 |
| 4,776,830 | 10/1988 | Fujikawa et al. | 493/133 |

OTHER PUBLICATIONS

Ironman, Ralph, "Printed and Die-Cut Blanks-Inline from the Corrugator", *Boxboard Containers,* 11 1975.

*Primary Examiner*—William Terrell

*Attorney, Agent, or Firm*—Earle R. Marden; H. William Petry

[57] ABSTRACT

A method and apparatus to form tubular shaped individual cartons from a web of flat tubular material. The flat tubular material is advanced to a tube forming station whereat a portion thereof is bulged so that it can be inserted on a mandrel to maintain its shape. After insertion on the mandrel it is cut to form an individual carton separate from the web of flat tubular material.

1 Claim, 2 Drawing Sheets

MANDREL INSERTION MECHANISM IN A CARTON CONTAINER-FORMING DEVICE

INDUSTRIAL APPLICATION FIELD

This design concerns a mandrel insertion mechanism in a carton container-forming device, in which the machine-glazed paper is supplied continuous from a roll, and is formed to individual parallelepiped containers which are filled with juice or other content and then sealed. According to this design, after the machine-glazed paper is sealed longitudinally and formed into a tubelike part, it is cut to a certain length; and, at the same time, bottom sealing (or top sealing) is performed, followed by the insertion of the mandrel.

CONVENTIONAL TECHNIQUES

In a conventional insertion mechanism for inserting a mandrel into a flat tube part, a pair of suckers are arranged opposite to each other in the vertical direction between the transporting line and the mandrel; the suckers are designed to be able to perform reciprocal movement between the transporting line and the mandrel.

In this conventional mechanism, the suckers are adhered to the upper and lower surfaces of the flat tubelike part fed from the transporting line, and they transfer forward the flat tubelike part which is opened and set on the mandrel; afterwards, the suction is relieved and the suckers are detached from the flat tubelike part.

PROBLEMS TO BE SOLVED BY THE DESIGN

In the above-mentioned conventional mechanism, the insertion of the mandrel into the flat tubelike part is performed by using a pair of suckers to suck and transport the flat tubelike part; hence, an appropriate timing is needed with the transfer operation of the transportation line. The transfer speed is thus reduced.

In addition, for applying and relieving the suckers, a switching operation of the vacuum pump is needed; this makes the mechanism more complicated and more expensive. These are the problems.

The purpose of this design is to enhance the insertion speed and simplify the mechanism of the mandrel insertion mechanism.

Figure 1:
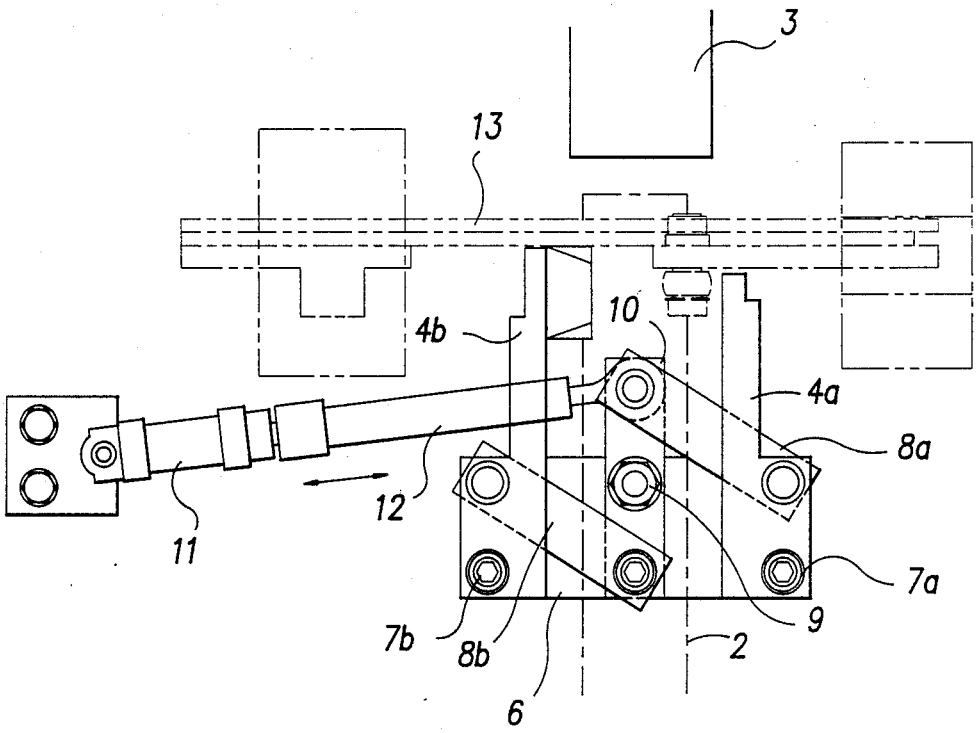
FIG. 1 is a top view illustrating an application example of this design.
Figure 2:
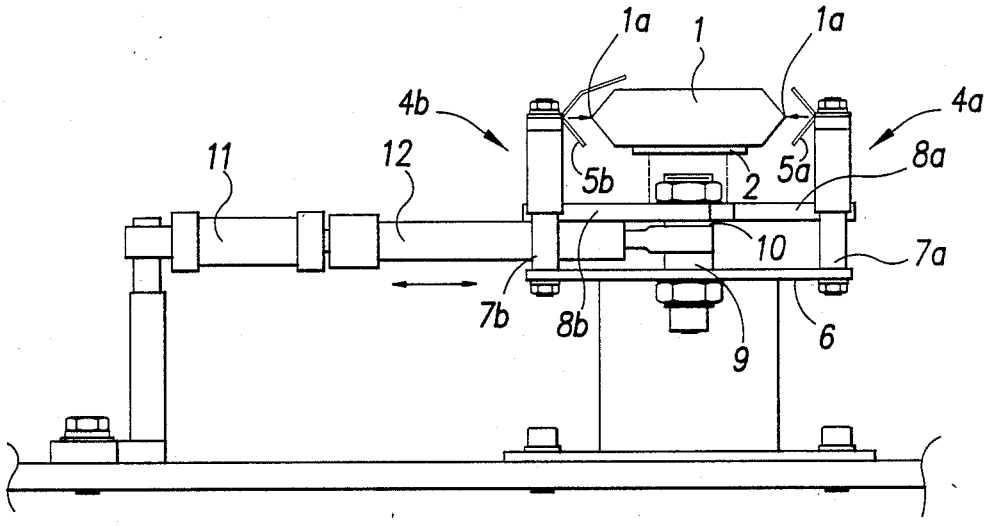
FIG. 2 is the front view of the same device and FIG. 3 is a site elevation view of FIG. 2.
Figure 3:
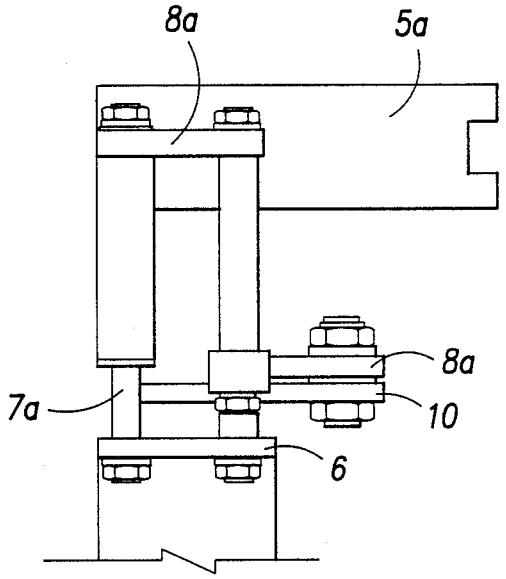

1...flat tubelike part;
2...transportation line;
3...mandrel;
4...oscillating arm

METHODS TO SOLVE THE PROBLEMS

According to this design, transportation line (2) is connected to mandrel (3) along a straight line; in the portion of transporting line (2) in front of mandrel (3), a pair of oscillating arms (4*a*), (4*b*) are arranged opposite to each other and are used to bulge flat tubelike part (1) that has been sealed longitudinally be pressing two side portions (1*a*) of the tubelike part inward.

Functions

Flat tubelike part, formed during the carton container formation process, is collinear with mandrel (3); hence, when flat tubelike part (1) is transported in the original direction, it can be set on mandrel (3).

In this process, a pair of oscillating arms (4*a*), (4*b*) arranged in front of mandrel (3) are turned to press inward two side portions (1*a*) of flat tubelike part (1) under transportation so that tubelike part (1) is bulged to form an opening, into which mandrel (3) in front of it can be inserted.

For flat tubelike part (1), after the machine-glazed paper is fed out and before longitudinal sealing is performed, folding lines are stamped on it for formation of parallelpipe; hence, it forms an opening where its two side portions (1*a*) are pressed. In addition, if folding is performed as a preparatory stage, the opening can be formed more reliable and more easily.

Functions

Flat tubelike part, formed during the carton container formation process, is collinear with mandrel (3); hence, when flat tubelike part (1) is transported in the original direction, it can be set on mandrel (3).

In this process, a pair of oscillating arms (4*a*), (4*b*) arranged in front of mandrel (3) are turned to press inward two side portions (1*a*) of flat tubelike part (1) under transportation so that tubelike part (1) is bulged to form an opening, into which mandrel (3) in front of it can be inserted.

For flat tubelike part (1), after the machine-glazed paper is fed out and before longitudinal sealing is performed, folding lines are stamped on it for formation of parallelpipe; hence, it forms an opening where its two side portions (1*a*) are pressed. In addition, if folding is performed as a preparatory stage, the opening can be formed more reliably and more easily.

Application Example

In the following, an application example will be presented with reference to figures.

A flat tubelike part (1) that has been sealed longitudinally is carried on a transportation line (2); in front of transportation line (2); in front of transportation line 2, there is mandrel (3).

Hence, transportation line (2) and mandrel (3) are arranged collinearly with respect to each other. When flat tubelike part (1) is moved forward, it will hit mandrel (3).

In the portion of transportation line (2) in front of mandrel (3), a pair of oscillating arms (4*a*) and (4*b*) are installed on the outer sides of two side portions (1*a*) of flat tubelike part (1) carried on transportation line (2).

Pressing portions (5*a*) and (5*b*) of oscillating arms (4*a*) and (4*b*) have an angular shape to ensure reliable pressing.

In addition, for oscillating arms (4*a*) and (4*b*), the base portions on the side farther away from the mandrel are pivoted by (7*a*) and (7*b*) so that they can rotate on stationary plate (6). The front portions are coupled by link rods (8*a*) and (8*b*) with actuating rod (10) which has its central portion pivoted by (9) on above-mentioned stationary plate (b) in a freely rotatable way; one end of activating rod (10) is coupled to piston rod (12) of cylinder (11).

Hence, when piston rod (12) of cylinder (11) moves back and forth, activating rod (10) is rocked; through link rods (8*a*) and (8*b*), it drives oscillating arms (4*a*) and (4*b*) and rocks them in opposite directions around pivots (7*a*) and (7*b*). In this way, the oscillating arms are pressed on or released from two side portions (1*a*) of tubelike part (1).

As the pressing force increases gradually when it comes nearer mandrel (3), tubelike part (1) is opened gradually in a smooth way. In this way, mandrel (3) is inserted into the opening of the tubelike part.

The insertion portion for setting tubelike part (1) on mandrel (3) should be rocked corresponding to the intermittent transportation of movement of tubelike part (1), which is then cut by cutter (13) to the desired length. For this purpose, cylinder (11) should be controlled properly so that when the tubelike part is transferred for insertion, oscillating arms (4*a*) and (4*b*) are moved inward to press on flat tubelike part (1); when the insertion is finished and the tubelike part is to be cut, they are moved outward from the tubelike part to facilitate the cutting operation.

Effects of the design

According to this design, the flat tubelike part is arranged to have its transportation direction collinear with the mandrel; when the flat tubelike part is to be set on the mandrel, its two sides are pressed to form an opening for insertion of the mandrel. In this way, insertion can be performed easily at a high speed.

In addition, the rocking operating of the oscillating arms is synchronized with the intermittent transportation movement of the flat tubelike part. Hence, compared with the conventional sucker scheme for sucking, moving, and detaching, the method of this design has the advantage of better timing, a simplified mechanism, and a higher operation speed.

I claim:

1. A mandrel insertion mechanism for a carton forming machine comprising: a pair of oscillating arms, means to supply a continuous sheet of flat tubular material along a path of travel between said pair of oscillating arms, a cup shaped pressing means mounted on each arm opening towards the path of travel of the flat tubular material, means to oscillate said arms to cause said cup shaped members to move towards one another to engage the edges of the flat tubular material to cause it to bulge, mandrel means operably associated with said arms receiving the bulged material thereon and cutting means between said mandrel and said arms to sever the bulged tubular material from the continuous sheet after it has been received on said mandrel.

* * * * *

UNITED STATES PATENT AND TRADEMARK OFFICE

CERTIFICATE OF CORRECTION

PATENT NO. : 4,934,994

DATED : June 19, 1990

INVENTOR(S) : Yoshimitsu Yokoyama

It is certified that error appears in the above-identified patent and that said Letters Patent is hereby corrected as shown below:

On the title page, item [57]:
In the ABSTRACT, line 1, delete "A method and" and substitute --An--

Column 1, line, 7, delete "the" and substitute --a web of--

Column 1, line 8, after "paper" insert --or material--

Column 2, line 53, after "angular" insert --or cup--

Signed and Sealed this

Twenty-sixth Day of November, 1991

*Attest:*

HARRY F. MANBECK, JR.

*Attesting Officer*

*Commissioner of Patents and Trademarks*